United States Patent [19]

Wiley

[11] Patent Number: 4,864,278

[45] Date of Patent: Sep. 5, 1989

[54] OPTICAL INTRUSION DETECTION SYSTEM AND METHOD

[75] Inventor: Wallace F. Wiley, Prairie Village, Kans.

[73] Assignee: Robert Hooke Memorial Laboratories, Inc., Prairie Village, Kans.

[21] Appl. No.: 11,596

[22] Filed: Feb. 6, 1987

[51] Int. Cl.[4] ..... G08B 13/18

[52] U.S. Cl. ..... 340/555; 250/221; 315/307

[58] Field of Search ..... 340/555, 693, 541, 309.15; 358/105, 108; 455/604–605; 250/221, 214 AL; 315/291, 307

[56] References Cited

U.S. PATENT DOCUMENTS

| | | | |
|---|---|---|---|
| 3,597,755 | 8/1971 | Parkin | 340/555 |
| 3,858,192 | 12/1974 | Fischer | 340/555 X |
| 3,859,648 | 1/1975 | Corbin | 340/555 |
| 3,935,505 | 1/1976 | Spiteri | 315/291 X |
| 3,972,021 | 7/1976 | Leitz et al. | 340/555 X |
| 4,042,816 | 8/1977 | Smoot | 340/61 X |
| 4,199,753 | 4/1980 | Gontowski, Jr. | 340/555 |
| 4,433,328 | 2/1984 | Saphir et al. | 340/555 |
| 4,628,230 | 12/1986 | Krokaugger | 315/291 X |
| 4,651,144 | 3/1987 | Pagano | 340/693 |

*Primary Examiner*—Glen R. Swann, III
*Assistant Examiner*—Thomas J. Mullen, Jr.
*Attorney, Agent, or Firm*—Arvid V. Zuber

[57] ABSTRACT

A method and apparatus for normally illuminating a monitored area with light applied at a relatively low intensity, and increasing the illumination automatically when intrusion into the monitored area occurs. A flood lamp normally operates at reduced power to illuminate the area, and a lens focuses the light on a photocell. Intrusion into the monitored area creates a change in the amount of light received by the photocell and produces a signal which is amplified and used to initiate a two minute timer. The two minute timer output initiates a 1.5 minute timer which causes the lamp to operate at full power during its 1.5 minute timing cycle. The lamp then reverts to its low power operating mode, and the additional one half minute timing cycle of the two minute timer provides adequate time for dissipation of transient responses which occur when the lamp is dimmed. A regulator circuit prevents unwanted variations in illumination as a result of spurious variations in the power to the floodlamp.

2 Claims, 2 Drawing Sheets

OPTICAL INTRUSION DETECTION SYSTEM AND METHOD

BACKGROUND AND SUMMARY OF THE INVENTION

This invention relates generally to security systems and more particularly to a method and apparatus for optically detecting activity within a monitored area.

Systems which monitor buildings for security purposes generally use ultrasonic, infrared or microwave techniques in order to sense activity in the area that is being monitored. An audible alarm is typically generated in order to alert the occupants and scare away the would-be intruder. The systems presently in use typically require sophisticated components which results in both high initial cost and high ongoing maintenance costs.

The present invention is directed to a method and apparatus which makes use of optical techniques to monitor a selected area and which responds to activity in the monitored area by increasing its illumination. This approach is advantageous not only for an intrusion detecting system but also for lighting systems in industrial and commercial areas such as corridors and warehouses. When the system is used for security, the increased light is sufficient by itself to frighten away prowlers. In industrial and commercial applications, corridors and warehouses can normally be illuminated only dimly but can automatically be fully illuminated when personnel such as watchmen are in the area.

It is the object of this invention to provide a method and apparatus for illuminating a selected area at a relatively low level of light under normal conditions and at an increased level of illumination when activity takes place in the monitored area. The automatic increase in the illumination of the monitored area leads prowlers to believe their presence has been discovered and thus causes them to flee the area without the need for an audible alarm signal. It is possible, however, for the system to be equipped with an audible alarm or an alarm system which signals a remote location such as a police station.

Another object of this invention is to provide a method and apparatus of the character described which has application both in a security system and in a general lighting system for industrial and commercial buildings such as warehouses and other largely unoccupied areas.

A further object of the invention is to provide a method and apparatus of the character described which can be implemented in a simple and economical manner and which consumes little energy in operation. The simplicity of an optical system as compared to ultrasonic, infrared or microwave systems leads to cost advantages. In addition, the flood lamp or other light source is normally operated at a low power level and thus consumes less energy than a light which is operating at full power.

A further object of this invention is to provide, in an apparatus of the character described, a control circuit which compensates for variations in the power line voltage. This compensation provides an extremely constant low level of illumination to the monitored area under normal conditions, thus allowing the system to have a much greater sensitivity to intrusions than otherwise would be possible.

Yet another object of the invention is to provide a method and apparatus of the character described which responds to either increased or decreased light reflected from the monitored area.

A still further object of the invention is to provide, in an apparatus of the character described, a control circuit which is arranged to minimize the effects of lightning.

Other and further objects of the invention, together with the features of novelty appurtenant thereto, will appear in the course of the following description.

DETAILED DESCRIPTION OF THE INVENTION

Figure 1:
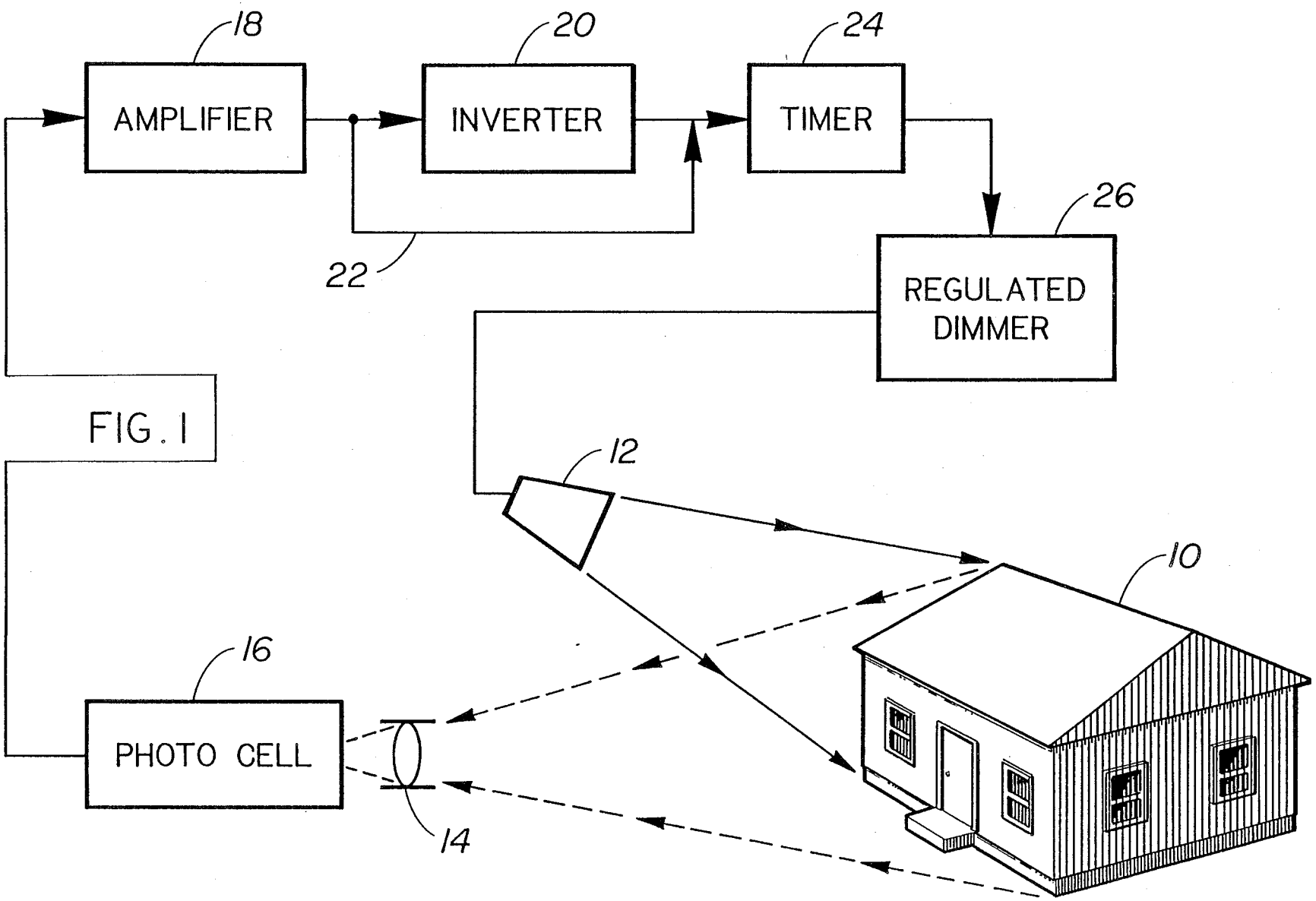
Figure 2:
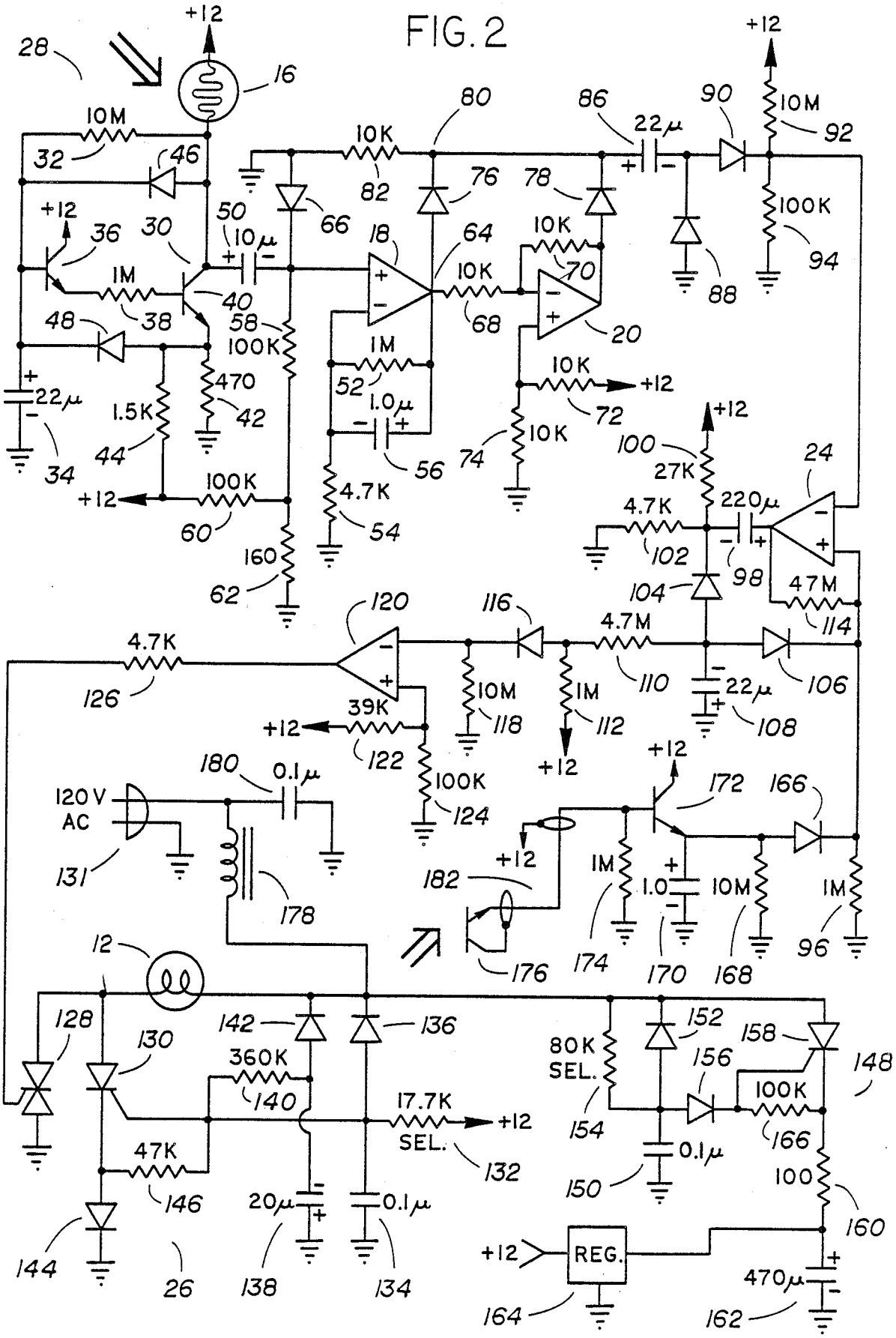

In the accompanying drawings which form a part of the specification and are to be read in conjunction therewith and in which like reference numerals are used to indicate like parts in the various figures:

FIG. 1 is a functional block diagram diagrammatically illustrating a system constructed according to a preferred embodiment of the present invention; and FIG. 2 is a schematic illustration of an embodiment of the circuit for the system.

Referring now to FIG. 1, the method and apparatus of the present invention has application in the monitoring of a building such as residence 10. A conventional incandescent flood lamp 12 or another dimmable light source serves to illuminate the house and adjacent area which is to be monitored for the presence of prowlers and would-be intruders. The light which is directed into the illuminated area is reflected toward photocell 16 and is directed to photocell 16 either by a lens 14 as shown, or by a black tube, not shown. Although a black tube is far less expensive, it is sometimes necessary to use the lens in applications where the masking of certain illuminated areas is advantageous. For purposes of simplifying this description, the term lens is used herein to mean either black tube or lens.

Any activity in the illuminated area is seen as a shift in the average illumination level by photocell 16. This shift is amplified by amplifier 18 and is applied both uninverted by path 22, and inverted, by inverter 20, to timer 24. Thus, any shift in reflected illumination, be it an increase or a decrease, initiates the timer 24. The output of timer 24 controls the output of regulated dimmer 26. When timer 24 is inactive, regulated dimmer 26 supplies flood lamp 2 with $\frac{1}{4}$ of its normal power. When timer 24 is active, regulated dimmer 26 supplies flood lamp 12 with full power.

Referring now to FIG. 2 for detailed circuit descriptions, the photocell 16 is connected between the +12 volt supply and circuit 28, the function of which is to adjust the effective resistance in series with the photocell so that it is approximately the same as the operating resistance of the photocell. By matching these resistances, the sensitivity of the circuit to variations in light level remains more or less constant regardless of the average level of light incident on photocell 16. Those skilled in the art will recognize that circuit 28 is not absolutely necessary for operation of the system, but enhances the operation considerably over the use of a simple series resistor.

Assuming photocell 16 goes from dark to light, its resistance will decrease, causing the voltage at junction 30 to rise. This increase in voltage causes capacitor 34 to slowly assume a greater charge through resistor 32. The voltage across capacitor 34 is coupled to the base of transistor 36 which is connected as an emitter follower.

The increase in voltage across capacitor 34 results in a large increase in current through transistor 36 which is coupled through resistor 38 to the base of transistor 40. This rise in current in the base of transistor 40 results in a decrease of the effective resistance of transistor 40 which results in a decrease in the voltage at junction 30. Those skilled in the art will understand that this negative feedback circuit will tend to maintain the voltage at junction 30 constant regardless of the resistance of photocell 16, but only over a long period of time. Any relatively fast changes in the resistance of photocell 16 will result in a variation in the voltage at junction 30, thus detecting intrusions into the illuminated area. Resistors 42 and 44 form a voltage divider that produces a bias on the emitter of transistor 40. This bias is selected for optimum performance of the circuit over the range of illuminations encountered by photocell 16. Diodes 46 and 48 are employed to speed up the recovery of circuit 28 after gross illumination shifts or start up.

Variations in the voltage at junction 30 are coupled through capacitor 50 to the non-inverting input of amplifier 18. This amplifier has a gain determined by the ratio of resistors 52 and 54, and is about 210. Capacitor 56 is used to slow down the response time of the amplifier in order to eliminate lamp flicker and false responses due to birds, etc. The non-inverting input of this amplifier is biased through resistor 58 by a voltage divider consisting of resistors 60 and 62. Resistor 62 is selected to set the static voltage at junction 64 to ½ of the supply voltage, or +6 volts. Diode 66 is used to protect the input of amplifier 18 from negative voltages.

Those skilled in the art will recognize the circuit consisting of amplifier 20 and resistors 68, 70, 72 and 74 as being a standard unity gain inverter. Variations in the output of amplifier 18 are reproduced inverted but with the same amplitude at the output of amplifier 20. These two output signals are combined through diodes 76 and 78 in junction 80. A rise in voltage at junction 80 is coupled through capacitor 86 and diode 90 to the inverting input of amplifier 24 which is connected as a timer. Diode 88 keeps any negative going signals from appearing on the input of amplifier 24. Resistors 92 and 94 from a voltage divider that produces a small positive bias on the inverting input of amplifier 24 of about +0.12 volts.

The output of amplifier 24 is normally positive because the voltage on the non-inverting input of the amplifier is held at about +2 volts which is more positive than the +0.12 volts on the inverting input. This +2 volts comes from the voltage divider circuit consisting of the resistors 96, 110 and 112 and the diode 106.

A positive signal on the inverting input of amplifier 24 produces a fall in voltage at the output of the amplifier. This output falls from about +11 volts to 0 volts. The 11 volt fall is coupled through capacitor 98 to the junction of resistors 100 and 102. Since the junction of these resistors is biased to about +1.8 volts, the +11 volts to 0 volts fall is converted to a +1.8 volts to −9.2 volts fall. The negative portion of this fall is coupled through diode 104 to capacitor 108. Since diode 104 has an offset of 0.5 volts, the resulting charge on capacitor 108 is −8.7 volts.

As soon as the charge on capacitor 108 goes negative, diode 106 ceases conduction and the voltage at the non-inverting input of amplifier 24 falls to ground potential. This causes the output of amplifier 24 to stay at ground. With capacitor 108 at −8.7 volts, the voltage at the junction of resistors 110 and 112 falls to +8.4 volts resulting in a voltage at the inverting input of amplifier 120 of +7.9 volts, the additional 0.5 volt drop due to the offset of diode 116. This +7.9 volts is more negative than the voltage at the non-inverting input of amplifier 120, which is about +8.6 volts as determined by the voltage divider formed by the resistors 122 and 124. With the inverting input more negative than the non-inverting input, the output of amplifier 120 goes positive. This positive voltage is fed through resistor 126 to the gate of TRIAC 128, causing the TRIAC to conduct, thus applying full 120 volt AC line power to the flood lamp 12. It can be seen by those skilled in the art that a relay or other electronic device can be used in place of the TRIAC to short out the regulated dimmer 26 in order to supply the flood lamp 12 with full power.

After receiving its −8.7 volt charge, capacitor 08 slowly discharges through resistors 110 and 112 to the +12 volt supply. After an elapsed time of about 30 seconds, the voltage at the junction of the resistors 110 and 112 has risen sufficiently to cause the inverting input of amplifier 120 to be more positive than the non-inverting input. This causes the output of amplifier 120 to revert to its normal ground potential, resulting in TRIAC 128 becoming non-conducting, thus restoring flood lamp 12 to its normal ¼ power state.

After an additional period of approximately 30 seconds, the voltage across capacitor 108 has risen sufficiently positive to cause the non-inverting input of amplifier 24 to be more positive than the inverting input. This causes the output of amplifier 24 to revert to its normal positive voltage state. The additional 30 seconds is required to allow the voltages in capacitors 34 and 50 to re-stabilize following the reduction of illumination from flood light 12. Those skilled in the art will recognize that other timer circuit configurations and other times can be used in place of this embodiment.

Under normal conditions, when TRIAC 128 is non-conducting, the current through flood lamp 12 is controlled by SCR 130 which is, in turn, only allowed to conduct about ¼ of a cycle, or 90°. This angle of conduction is primarily controlled by the resistor 132 and capacitor 134. Capacitor 134 receives a negative charge of about 165 volts through diode 136 from the 120 v AC power source 131. With the gate of SCR 130 connected to capacitor 134, the anode circuit will remain non-conducting as long as this voltage remains negative.

The negative 165 volt charge on capacitor 134 discharges through resistor 132 to the regulated +12 volt supply. Resistor 132 is selected so that the voltage at the gate of SCR 130 rises sufficiently positive with respect to its cathode to cause SCR 130 to become conducting at approximately the positive peak of the 120 v AC supply 131. Since SCR 130 will become non-conducting as soon as the 120 V AC supply goes negative, it can be seen that SCR 130 is only conducting ¼ of the time, and, consequently, flood lamp 12 is operating at ¼ power.

With capacitor 134 receiving its charge directly from the 120 V AC power source, any variation in this source voltage causes a like variation in the charge received by capacitor 134. With the discharge of capacitor 134 being through resistor 132 to a regulated voltage, any voltage variation that would cause a variation in the intensity of flood lamp 12 is partially neutralized. Additional compensation is accomplished by the circuit consisting of capacitor 138, resistor 140 and diode 142. Since the time constant of resistor 140 and capacitor 138 is long compared with the 60 hz power, the negative voltage on capacitor 138 is only a function of the peak voltage of the 120 v AC power source. If the 120 v AC power source voltage varies, this variable voltage is fed through resistor 140 to the gate of SCR 130 to almost perfectly compensate the conduction angle of SCR 130 so that flood lamp 12 does not vary in intensity appreciably with 120 v AC power source variations. Diode 144 protects SCR 130 from reverse voltages. Resistor 146 provides a conduction path between the gate and cathode of SCR 130.

It will be understood, therefore, that the circuit including SCR 130, resistor 132, capacitor 134, diode 136, capacitor 138, resistor 140, diodes 142 and 144, and resistor 146 provides a regulator circuit to compensate for possible variations in the voltage from source 131. Such regulation is, of course, important to a system which optically senses variation in the illumination from lamp 12 for activation of the response from the system. Fluctuations in such illumination which would result from variations in the power source for the lamp could result in false sensings from the illuminated area and must be avoided to the extent possible. The regulator circuit herein described serves to insure that appreciable variations in light output do not occur as a result of line power variations.

The regulated +12 volts used throughout the circuit, is supplied by power supply circuit 148. Capacitor 150 is charged to the negative peak of the 120 volt AC supply through diode 152. As long as the voltage at the anode of diode 156 remains negative, diode 156 is non-conducting. Capacitor 150 discharges through resistor 154 until the anode of diode 156 becomes positive with respect to its cathode. At this point, diode 156 goes into conduction, causing the gate of SCR 158 to conduct, which causes SCR 158 to clamp the junction of resistors 160 and 166 to the 120 volt AC supply. Resistor 154 controls the point of conduction of SCR 158 to the last few degrees of the positive voltage portion of 120 volt AC cycle. This positive spike is conducted through resistor 160 and is used to voltage on capacitor 162 at 15 to 20 volts. The voltage at capacitor 162 is passed through regulator 164 to provide the regulated +12 volts used throughout the other circuits. Resistor 166 is used to provide a conducting path between the gate and the cathode of SCR 158.

The purpose of circuit 182 is to reduce the effects of lightning flashes when the system is installed outdoors. Photo transistor 176 is mounted so that it is shielded from flood lamp 12 and its reflected light, but illuminated by any light coming from the sky. When a flash of lightning occurs, photo transistor 176 goes into conduction causing transistor 172 to conduct heavily resulting in a positive charge on capacitor 170. This positive voltage is conducted through diode 166 to the non-inverting input of amplifier 24, thus effectively deactivating this amplifier for the duration of the lightning flash and for a period of time thereafter. Resistor 174 provides a conduction path for the base of transistor 172 to ground. Resistor 168 provides a conductive path from the emitter of transistor 172 to ground.

Choke 178 in conjunction with capacitor 180 form a filter circuit to reduce any radio frequency interference generated by the circuits.

Having thus described the invention, I claim:

1. Intruder detection apparatus for controlling illumination of a preselected area comprising:

an incandescent light source for illuminating the area, said source being operable at a first level of intensity and a second level of intensity greater than the first, a power source for said light source capable of operating the light source at first and second levels of intensity, means for reducing and regulating the power from said power source thereby operating the light source at a constant, low, first level of intensity, a light sensitive receiver for sensing the illumination of the area provided by said first level of intensity, said receiver having an output signal which varies in response to variations in the amount of light sensed by the receiver, the variation resulting from the presence of an intruder, means for maintaining said light source at said first level of intensity when the output signal from said receiver has a normal, predetermined value, means for bypassing the means for reducing and regulating the low level power supplied to said light source, thereby operating the light source at said second level of intensity when said output signal varies from said normal, predetermined value because of an intruder, whereby the second level of intensity acts as an alarm.

2. Apparatus as set forth in claim 1, including means for sensing the illumination provided by lightning; and means for disabling the means for bypassing the means for reducing and regulating the low level power supplied to said light source in response to the means for sensing the illumination provided by lightning.

* * * * *